US010748705B2

(12) United States Patent
Yamada

(10) Patent No.: US 10,748,705 B2
(45) Date of Patent: Aug. 18, 2020

(54) MAGNETIC ELEMENT

(71) Applicant: SUMIDA CORPORATION, Chuo-Ku, Tokyo (JP)

(72) Inventor: Satoru Yamada, Natori (JP)

(73) Assignee: SUMIDA CORPORATION, Chuo-Ku, Tokyo (JP)

( * ) Notice: Subject to any disclaimer, the term of this patent is extended or adjusted under 35 U.S.C. 154(b) by 10 days.

(21) Appl. No.: 16/149,462

(22) Filed: Oct. 2, 2018

(65) Prior Publication Data

US 2019/0035549 A1 Jan. 31, 2019

Related U.S. Application Data

(63) Continuation of application No. 15/007,666, filed on Jan. 27, 2016, now Pat. No. 10,121,587.

(30) Foreign Application Priority Data

Feb. 3, 2015 (JP) ..... 2015-018991

(51) Int. Cl.
*H01F 41/02* (2006.01)

(52) U.S. Cl.
CPC ..... *H01F 41/0246* (2013.01)

(58) Field of Classification Search
CPC ... H01F 41/02; H01F 41/0206; H01F 41/0246
See application file for complete search history.

(56) References Cited

U.S. PATENT DOCUMENTS

| | | | |
|---|---|---|---|
| 8,207,808 | B2 | 6/2012 | Yamada et al. |
| 8,629,747 | B2 | 1/2014 | Yamada et al. |
| 8,922,317 | B2 | 12/2014 | Yamada et al. |
| 2001/0016977 | A1 | 8/2001 | Moro et al. |
| 2010/0134233 | A1 | 6/2010 | Wang et al. |
| 2014/0090235 | A1 | 4/2014 | Yamada et al. |
| 2014/0210586 | A1 | 7/2014 | Atsumi et al. |

FOREIGN PATENT DOCUMENTS

| | | | | |
|---|---|---|---|---|
| EP | 2608228 | A1 | 6/2013 | |
| JP | 2005191403 | A | 7/2005 | |
| JP | 2006324457 | A * | 11/2006 | |
| JP | 2006324457 | A | 11/2006 | |
| JP | 2011249770 | A * | 12/2011 | ..... H01F 41/10 |
| JP | 2014150093 | A * | 8/2014 | ..... H01F 27/292 |

OTHER PUBLICATIONS

Extended European Search Report corresponding to Application No. 15200982.5-1556; dated Jul. 14, 2016.
JPO Notification of Reasons for Refusal corresponding to JP Application No. 2015-018991; dated Nov. 7, 2018.

* cited by examiner

*Primary Examiner* — Joseph S Del Sole
*Assistant Examiner* — Jamel M Nelson
(74) *Attorney, Agent, or Firm* — Cantor Colburn LLP

(57) ABSTRACT

A magnetic element, comprising: a coil having two terminal-ends, a core pressed and molded around the coil, and two terminal units connecting to the two terminal-ends of the coil, wherein a first concave portions is formed on a side surface of the core, a second concave portion for accommodating one of the two terminal-ends of the coil, is formed at a upper boundary of the first concave portion, and a third concave portion for accommodating one of the two terminal units, is formed at a upper boundary of the first concave portion and near the second concave portion.

2 Claims, 10 Drawing Sheets

MAGNETIC ELEMENT

CROSS REFERENCES TO RELATED APPLICATIONS

This application is a continuation application of U.S. Patent Application Ser. No. 15/007,666, filed Jan. 27, 2016 and claims the benefit of priority to Japanese Patent Application JP2015-018991 filed on Feb. 3, 2015, the entire contents of which being incorporated herein by reference.

BACKGROUND OF THE INVENTION

Field of the Invention

The present invention relates to a manufacturing method of a magnetic element.

Description of the Related Art

For example, for a magnetic element such as an inductor or the like, there exists a type such as shown in Patent Document 1 (Japanese unexamined patent publication No. 2005-191403). In Patent Document 1 (see FIG. 4), there is disclosed a constitution in which a core with a coil embedded therein is formed by pressure-molding a magnetic material. In addition, in the constitution shown in the Patent Document 1, also a portion of a terminal unit is embedded inside the core.

SUMMARY OF THE INVENTION

Meanwhile, in the case of attempting to form the core of the magnetic element which is disclosed in the Patent Document 1 mentioned above, there are problems as follows. More specifically, with regard to a mold for pressure-molding the magnetic material, there exist a die on the upper side (upper-side die) and a die on the lower side (lower-side die), and a terminal unit and a coil are set such that the terminal unit is sandwiched between those dies. Thereafter, a magnetic material is filled in the inside of the die portions of the mold and the filled magnetic material is pressure-molded by using an upper-side punch and a lower-side punch.

For such a pressure-molding, it is necessary to add equal pressure forces to the filled magnetic material between the upper-side punch and the lower-side punch, at the same timing. However, the densities of the filled magnetic materials are not uniform between the upper-side punch and the lower-side punch. For this reason, although the same forces are added by the upper-side punch and the lower-side punch, because a relatively large number of gaps exist at the side of the magnetic material having a lower density the pressure transmitted to the terminal unit or the coil terminal-end is strongly attenuated at this side. On the other hand, a relatively small number of gaps are distributed at the side of the magnetic material having a higher density and, therefore, the pressure transmitted to the terminal unit or the coil terminal-end is not attenuated so much at this side. For this reason, there is a phenomenon that the core-side end of the terminal unit (or of the coil terminal-end) will move toward the side where the magnetic material has lower density and, as a result, the core-side end of the terminal unit (or of the terminal-end) will be deformed. In addition, because of such a movement, there is a case in which a large shear force is added to the terminal unit or the coil terminal-end and at least a portion of the terminal unit or the coil terminal-end is sheared.

The present invention was invented in view of such problems and seeks to provide a manufacturing method of a magnetic element in which even if at least one of the terminal unit and the coil terminal-end is deformed due to the difference between the densities of the magnetic materials, shearing is not caused at the terminal unit or the coil terminal-end.

A manufacturing method of a magnetic element of the present invention, using a magnetic material, is characterized by comprising the steps of: sandwiching and holding at least one of a terminal unit and a coil terminal-end of a coil between a tubular-shaped upper-side die and a tubular-shaped lower-side die, while positioning the coil in a tubular-shaped portion which is constituted by the upper-side die and the lower-side die; filling a magnetic material in the tubular-shaped portion after the step of sandwiching and holding; and pressure-molding a core, whose side surface follows the inner walls of the upper-side die and the lower-side die, by pressurizing the magnetic material, which was filled in the step of filling, by using an upper-side punch from the upper side and also by using a lower-side punch from the lower side, wherein at least a portion of the inner wall of the upper-side die at least a portion of the inner wall of the lower-side die are spaced from the center of the tubular-shaped portion by respective different distances and, due to the difference in said distances, a step is formed at a position where at least one of the terminal unit and the coil terminal-end is sandwiched in the tubular-shaped portion, and in the step of pressure-molding there is formed, by transcription of the step in the tubular-shaped portion, a core concave-portion comprising a step on the outside surface of the core, with at least one of the terminal unit and the coil terminal-end as a boundary.

Also, in addition to the abovementioned invention, it is preferable for another aspect of the manufacturing method of a magnetic element of the present invention that, for the core concave-portion, there is further provided a terminal concave-portion which is recessed at the side opposite to a mounting side lying in a direction toward which the terminal unit is bent, and there is further comprised a step of bending the terminal unit toward the mounting side.

Further, in addition to the abovementioned invention, it is preferable for another aspect of the manufacturing method of a magnetic element of the present invention that the terminal unit has an end that is proximate to the core and further recessed from the outside in the width direction so that it has a narrower width than that of the distal end of the aforesaid terminal unit.

Also, in addition to the abovementioned invention, it is preferable for another aspect of the manufacturing method of a magnetic element of the present invention that, in the step of pressure-molding, there is further formed a terminal concave-portion which is recessed from the side surface of the core and concurrently into which the terminal unit enters; and further, in the inside of the terminal concave-portion, there is integrally formed a conductive-wire concave-portion which is recessed compared with the aforesaid terminal concave-portion.

Further, in addition to the abovementioned invention, it is preferable for another aspect of the manufacturing method of a magnetic element of the present invention that the portion, at which the terminal unit and the terminal-end are positioned within at least one of the lower-side die and the upper-side die, has a flat shape.

[Effect of the Invention]

According to the present invention, in an manufacturing method of a magnetic element it becomes possible, even if at least one of the terminal unit and the coil terminal-end is deformed due to a difference in the densities of the magnetic material, to obtain a state in which shearing is not caused at the terminal unit or the coil terminal-end.

DESCRIPTION OF THE PREFERRED EMBODIMENTS

Hereinafter, there will be explained a manufacturing method of a magnetic element 10 relating to one exemplified embodiment of the present invention based on the drawings. It should be noted in the following explanation that, first, there will be an explanation with regard to the manufacturing method of the magnetic element 10 and, thereafter, there will be an explanation with regard to various kinds of magnetic elements 10. In addition, in the following explanation, an inductor is explained as the magnetic element 10, but the magnetic element is not limited to an inductor and the present invention is applicable also with regard to magnetic elements other than inductors (for example, transformers and the like).

Figure 1:
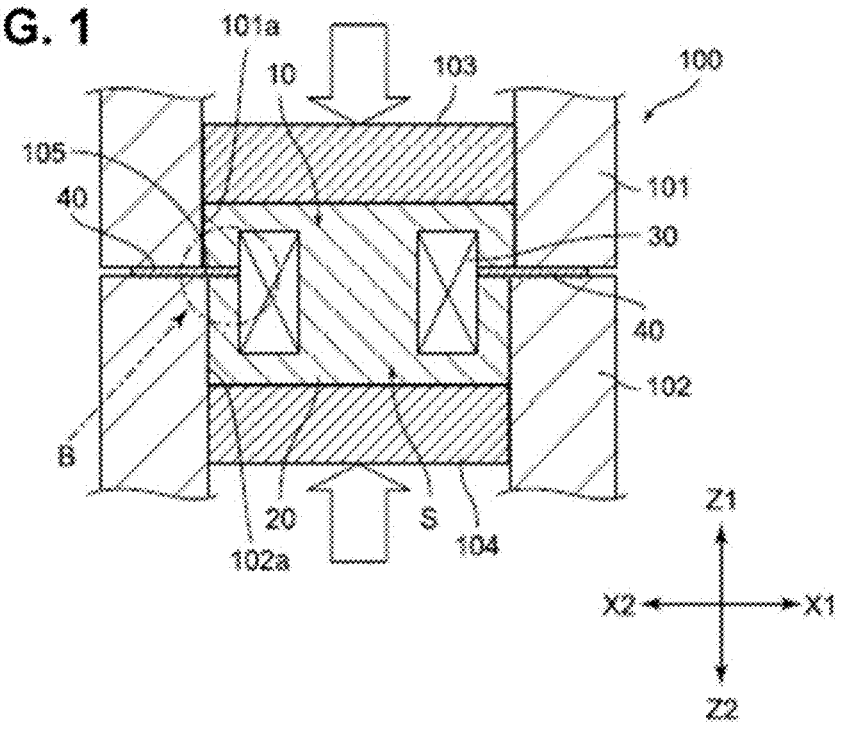
FIG. 1 relates to a manufacturing method of a magnetic element in one exemplified embodiment of the present invention and is a view showing an aspect when pressure-molding a magnetic material in the inside of a mold.
Figure 4:
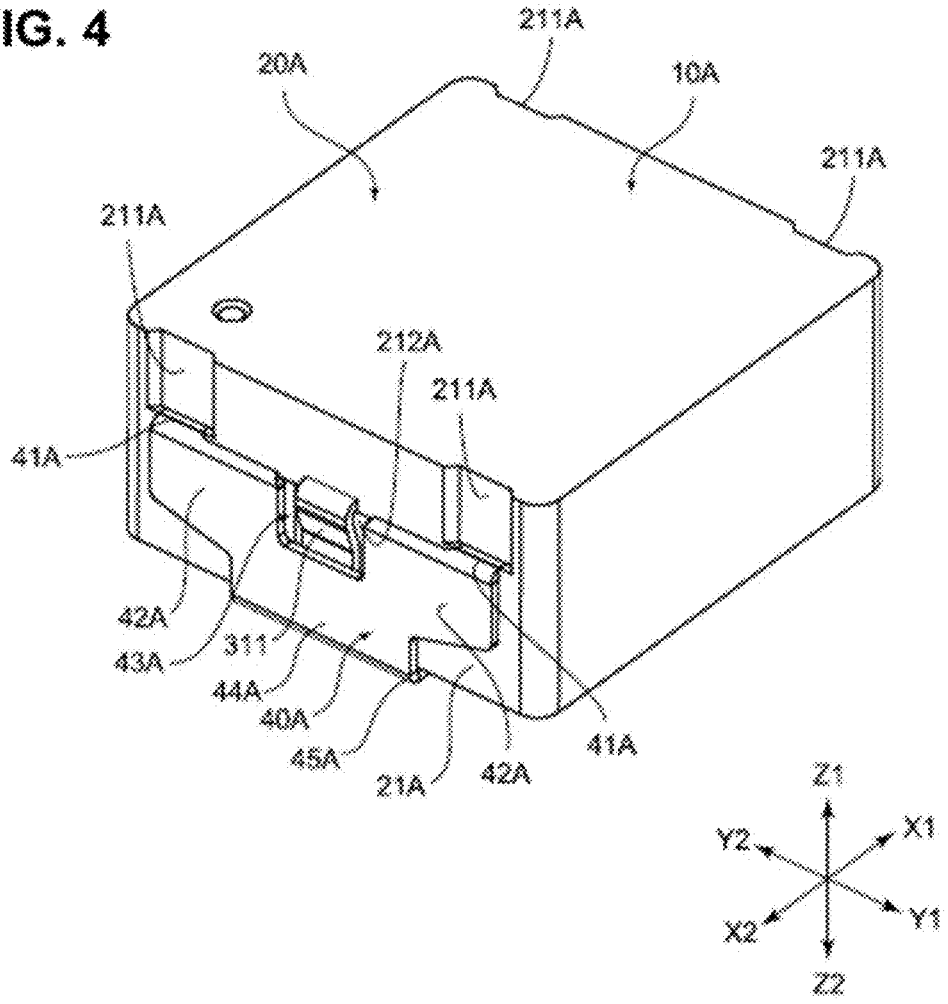
FIG. 4 is a perspective view showing a constitution of a magnetic element relating to a first constitutional example.

In addition, it is supposed in the explanation hereinafter that there is sometimes a case in which the explanation will be done by using an XYZ orthogonal coordinate system and, there, the explanation will be carried out by assuming that the up and down direction, in which an upper-side die 101 and a lower-side die 102 of a mold 100 are arranged, is to be the Z-direction, the upper side is to be the Z1 side, and the lower side is to be the Z2 side. In addition, the explanation will be carried out by assuming that the direction extending along the right and left direction in FIG. 1 is taken as the X-direction, the right side is taken as the X1 side and the left side is taken as the X2 side. Further, the explanation will be carried out by assuming that the width direction of the side surface 21A in FIG. 4 is taken as the Y-direction, the front & right side in FIG. 4 is taken as the Y1 side and the rear & left side in FIG. 4 is taken as the Y2 side.

<1. With Regard to a Manufacturing Method of Magnetic Element 10>

FIG. 1 relates to a manufacturing method of the magnetic element 10 in this exemplified embodiment and is a view showing an aspect when pressure-molding a magnetic material in the inside of the mold 100. As shown in FIG. 1, the mold 100 is provided with an upper-side die 101, a lower-side die 102, a punch on the upper side (upper-side punch) 103 and a punch on the lower side (lower-side punch) 104. With regard to those elements, through-holes are formed for the upper-side die 101 and the lower-side die 102. The shapes of both the through-holes are formed equivalently (except for the portions where there are steps 105, discussed below) but it is allowed to employ shapes that are a little bit different from one another. In addition, the upper-side punch 103 has a shape corresponding to that of the through-hole of the upper-side die 101 and, concurrently, the lower-side punch 104 has a shape corresponding to that of the lower-side die 102.

In the case of pressure-molding the magnetic material and forming the magnetic element 10 by using such a mold 100, an integrated semi-finished product composed of a coil 30 (which was formed by winding a conductive wire 31 beforehand) and a terminal unit 40 (which is connected to a terminal-end 311 of the coil 30) is set in the tubular-shaped lower-side die 102. It should be noted that this terminal unit 40 is a unit formed by punching-out a metal plate. Next, the upper-side die 101 is descended with respect to the lower-side die 102 so as to sandwich the terminal unit 40 and there is obtained a state in which the terminal unit 40 is sandwiched (corresponding to the sandwiching and holding process). Thereafter, there will be obtained a state in which the lower-side punch 104 is positioned at the lower portion of a tubular-shaped portion S which is surrounded by the upper-side die 101 and the lower-side die 102. Thereafter, a magnetic material will be filled into the tubular-shaped portion S (corresponding to the filling process).

The magnetic material is constituted by mixing magnetic powders and binders. For the magnetic powders constituting the magnetic material, it is possible to use magnetic metal powders such as of ferrite, permalloy, sendust, iron silicon chromium, iron carbonyl and the like or other powders obtained by forming various kinds of magnetic materials in powder states. In addition, for the materials of the binders, there can be listed PET (polyethylene terephthalate), polyethylene, vinyl chloride, synthetic rubber, natural rubber, silicone, epoxy and the like.

In addition, the coil 30 is wound by using a round wire or a rectangular wire which is covered by an insulating coating. Then, the terminal-end 311 of the coil 30 and the terminal unit 40 are joined in an electrically conductive state. In that case, for example, it is allowed to join the terminal-end 311 of the coil 30 and the terminal unit 40 by soldering and it is also allowed to join them by resistance welding, by arc welding, by laser welding or the like.

Subsequently, an upper-side punch 103 is inserted from the upper portion of the tubular-shaped portion S and the magnetic material is pressure-molded (corresponding to the pressure-molding process). Owing to that procedure, there is formed a core 20 in which the magnetic material is in an uncured state. It should be noted that, after this pressure-molding process, there is generally carried out a thermosetting process for accelerating the bonding between the particles of the magnetic material by heating the core 20 under a temperature lower than the melting-point temperature of the magnetic powder of the magnetic material.

In addition, after the pressure-molding process (specifically, after the thermosetting process), the terminal unit 40 is bent so as to be directed toward the bottom surface of the core 20. Further, the terminal unit 40 is bent so as to form a planar surface that will constitute the bottom surface of the magnetic element. Thereby, there is formed a magnetic element 10 of an SMD (Surface Mount Device) type.

Figure 2:
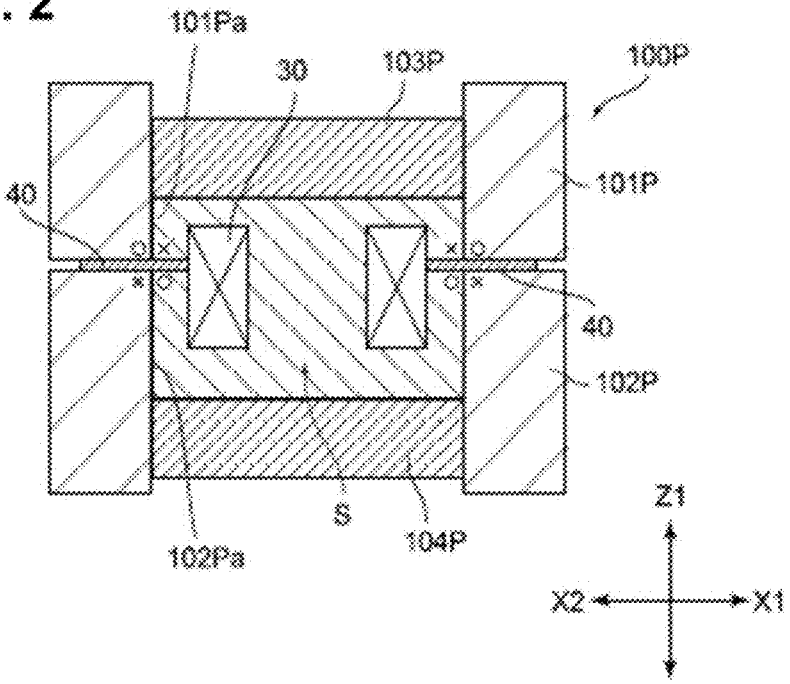
FIG. 2 relates to a manufacturing method of a magnetic element in a comparative example and is a view showing an aspect when pressure-molding a magnetic material in the inside of a mold.

FIG. 2 relates to a manufacturing method of a magnetic element according to a comparative example and a view showing an aspect when pressure-molding a magnetic material in the inside of a mold 100P. It should be noted in the following explanation that the mold used to manufacture the magnetic element relating to this comparative example is referred to as a mold 100P and in addition, also with regard to respective portions of the mold 100P, it is assumed that they will be referred to by attaching the reference numeral "P" if needed. According to the structure shown in FIG. 2, when moving the upper-side punch 103P toward the downward side and further, when moving the lower-side punch 104P toward the upward side, defects such as described hereinafter will be caused.

Specifically, in a case in which the density of the magnetic material on the side of the lower-side punch 104P is higher than the density of the magnetic material on the side of the upper-side punch 103P, at least one of the terminal unit 40 and the coil terminal-end 311 will be deformed. More specifically, with respect to a portion (within at least one of the terminal unit 40 and the coil terminal-end 311) that protrudes from the core 20, deformation is caused such that the displacement will become large in the up and down direction (Z-direction) and, concurrently, there is caused a force, which shears the terminal unit 40 or the coil terminal-end 311, between the corner portion of the inner wall 101Pa of the upper-side die 101P (i.e. indicated by "○" in FIG. 2) and the corner portion of the side wall of the core 20, which is positioned at the lower surface of the terminal 40 or the coil terminal-end 311 (i.e. indicated by "○"). For this reason, there is sometimes a case in which at least one of the terminal unit 40 and the coil terminal-end 311 will be broken.

In addition, in a case in which the density of the magnetic material on the side of the upper-side punch 103P is higher than the density of the magnetic material on the side of the lower-side punch 104P, at least one of the terminal unit 40 and the coil terminal-end 311 will be deformed. More specifically, with respect to a portion (within at least one of the terminal unit 40 and the coil terminal-end 311) that protrudes from the core 20, deformation is caused such that the displacement will become large in the up and down direction (Z-direction) and, concurrently, there is caused a force, which shears the terminal unit 40 or the coil terminal-end 311, between the corner portion of the inner wall 102Pa of the lower-side die 102P (i.e. indicated by "x" in FIG. 2) and the corner portion of the side wall of the core 20, which is positioned at the upper surface of the terminal 40 or the coil terminal-end 311 (i.e. indicated by "x"). For this reason, there is sometimes a case in which the terminal unit 40 or the coil terminal-end 311 will be broken.

Figure 3:
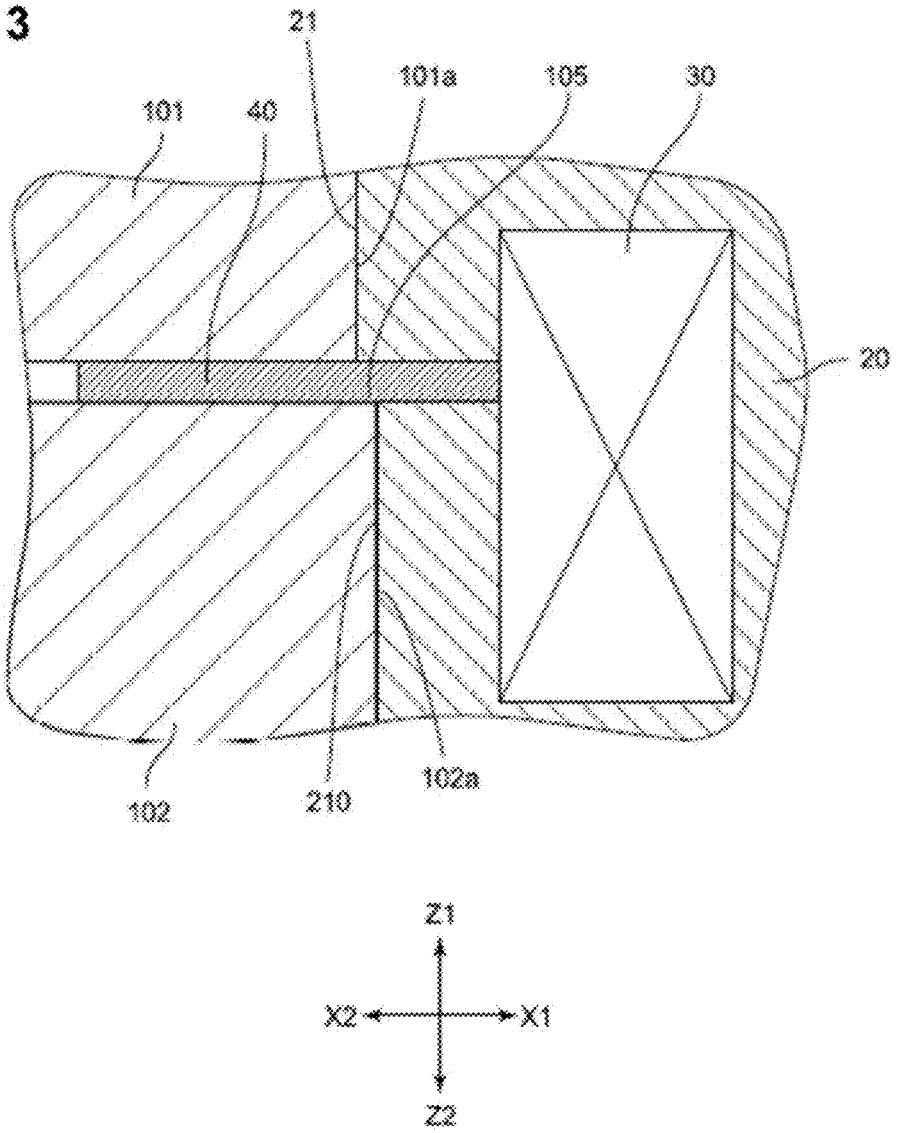
FIG. 3 is an enlarged view showing the vicinity of portion B, at the core end of a terminal unit, in FIG. 1.

Against such a problem, the magnetic element 10 is manufactured in this exemplified embodiment by using the mold 100 as shown in FIG. 1 and FIG. 3.

FIG. 3 is an enlarged view showing the vicinity of a portion labelled B in FIG. 1, at the core-side end of a terminal unit 40. As shown in FIG. 1 and FIG. 3, at least at a certain position (or positions) along the periphery of the tubular-shaped portion S, the inner wall 101*a* of the upper-side die 101 and the inner wall 102*a* of the lower-side die 102 are different in the distances with respect to the center of the tubular-shaped portion S. Then, due to the difference in these distances, a step 105 is formed in the tubular-shaped portion S when the terminal unit 40 or the coil terminal-end 311 is sandwiched.

In other words, as shown in FIG. 3, for the core-side end of the terminal unit 40 or the coil terminal-end 311, the line along which the inner wall 101*a* of the upper-side die 101 follows along the up and down direction and the line along which the inner wall 102*a* of the lower-side die 102 follows along the up and down direction are not positioned on the same straight line and are positioned at positions that are spaced apart from each other by a distance L in the X-direction. For this reason, at the boundary position where the terminal unit 40 or the coil terminal-end 311 is sandwiched between the upper-side die 101 and the lower-side die 102, there is formed a step 105.

For this reason, on the side surface 21 of the core 20 of the magnetic element 10, the step 105 of the mold 100 is transcribed. More specifically, it becomes a state in which there is formed a concave portion having a step difference on the side surface 21 of the core 20.

(With Regard to the Operational Effect of Step 105)

Depending on the existence of such a step 105, it is possible to cause the following operational effect. More specifically, supposing that the density of the magnetic material on the side of the upper-side punch 103 is higher than the density of the magnetic material on the side of the lower-side punch 104, the terminal unit 40 or the end portion of the coil 30 is deformed toward the side of the lower-side punch 104 and, concurrently, in the vicinity of the step 105, the terminal unit 40 or the terminal-end 311 of the coil 30 and the magnetic material are pressed down toward the downward direction. However, with regard to this pressing-down, the corner portion of the side wall of the core 20 which is positioned upon the end portion of terminal unit 40 or the coil 30 is received by the step difference 105 and, therefore, it becomes possible to prevent such a pressing-down effectively.

In addition, through receiving the load by the step 105, the shearing load for shearing the terminal unit 40 becomes small and, therefore, it becomes possible to effectively prevent a phenomenon in which the terminal unit 40 will be broken.

On the contrary, in a case in which the density of the magnetic material on the side of the lower-side punch 104 is higher than the density of the magnetic material on the side of the upper-side punch 103, in the vicinity of the step 105 it is not possible to receive the load in which the terminal unit 40 or the end portion of the coil 30 and the magnetic material are pressed up toward the upward direction. However, for the terminal unit 40, there are formed spaces for escaping the stress among the inner wall 101*a* side, the step 105 and the side surface 21 of the core 20 having a concave portion. For this reason, when compared with the configuration in the past, it becomes possible to prevent concentration of the shearing stress. For this reason, it becomes possible to effectively prevent the terminal unit 40 from being broken.

<2. With Regard to a First Constitutional Example of Magnetic Element 10>

Figure 5:
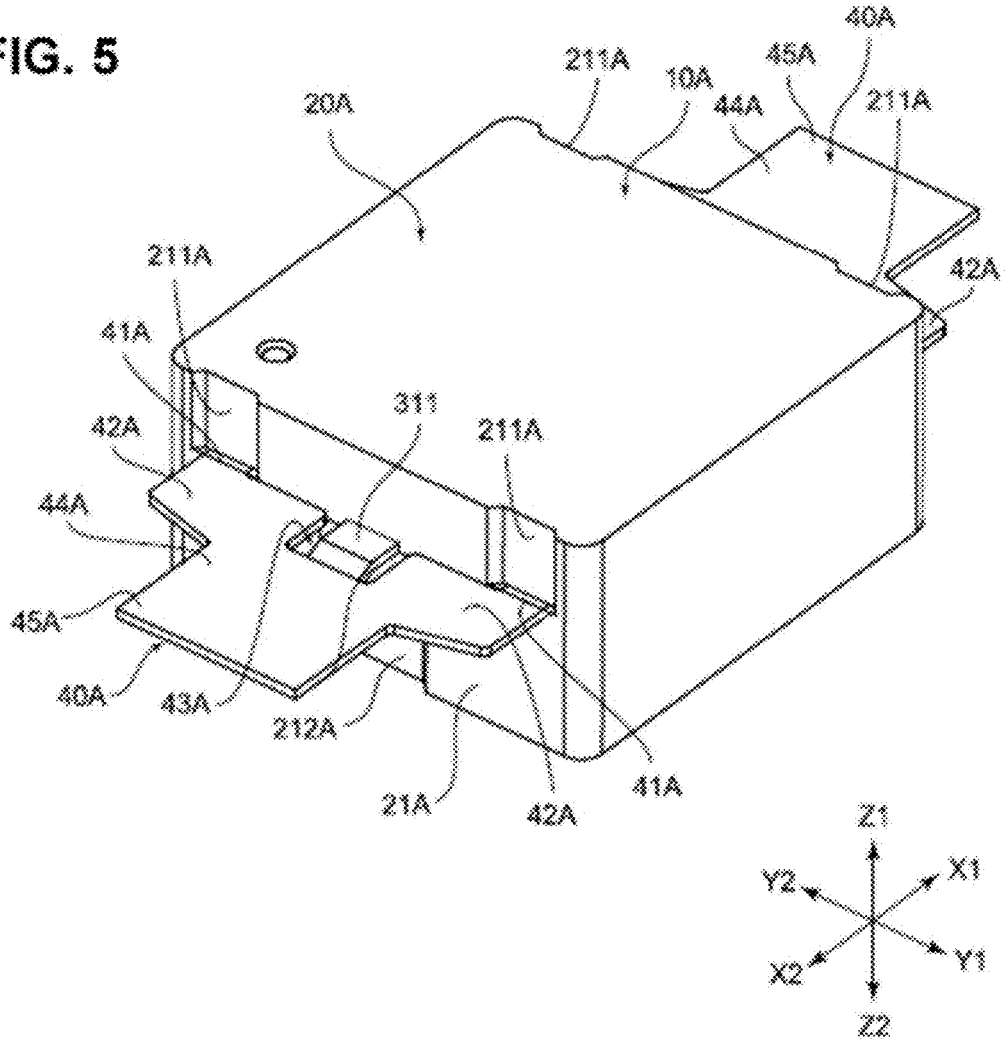
FIG. 5 is a perspective view showing a constitution of the magnetic element relating to the first constitutional example and is a perspective view showing a state before bending the terminal-end and the terminal unit.
Figure 6:
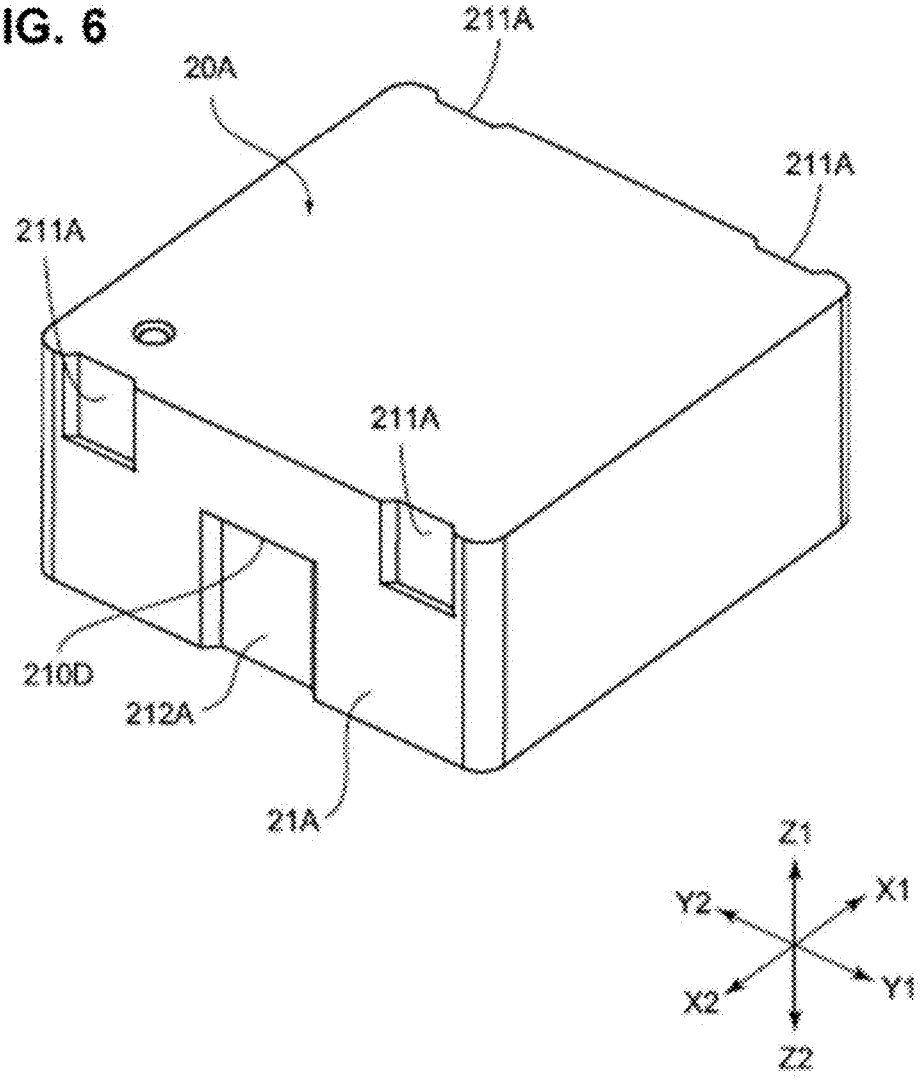
FIG. 6 is a perspective view showing a constitution of a core in the magnetic element relating to the first constitutional example.

Next, there will be explained a first constitutional example of a magnetic element 10 relating to this exemplified embodiment. It should be noted that, in the following explanation, the magnetic element 10 relating to the first constitutional example is referred to as a magnetic element 10A and, in addition, also with regard to respective portions of the magnetic element 10A, it is assumed that they will be referred to by attaching the reference numeral "A" if needed. FIG. 4 is a perspective view showing a constitution of a magnetic element 10A according to the first constitutional example. FIG. 5 is a perspective view showing a constitution of the magnetic element 10A according to the first constitutional example and is a perspective view showing a state before bending the terminal-end 311 and the terminal unit 40A. FIG. 6 is a perspective view showing a constitution of a core 20A in the magnetic element 10A according to the first constitutional example.

Also in the magnetic element 10A according to the first constitutional example, the core 20A, the coil 30 (in FIG. 4 to FIG. 6, there is illustrated only the terminal-end 311 of the conductive wire 31 constituting the coil 30) and the terminal unit 40A are employed as the constituent elements thereof.

As shown in FIGS. 4 to 6, a plurality of concave portions are provided on the side surface 21A of the core 20A. Among these concave portions, at respective positions towards the edges of the side surface 21A, there are provided terminal concave-portions 211A respectively. More specifically, the terminal concave-portions 211A are provided as a pair of portions. The terminal concave-portions 211A are positioned at the boundaries at which the terminal unit 40A enters into the inside of the core 20A and protrudes towards the outside. More specifically, downward from the terminal unit 40, which is the boundary, the outside of the core 20A is formed as the side surface 21A, and upward from the terminal unit 40 which is the boundary, there are provided the terminal concave-portions 211A which are recessed from the side surface 21A.

In addition, at a central position in the width direction (Y-direction) of the side surface 21A, there is provided a conductive-wire concave-portion 212A. The conductive-wire concave-portion 212A is a concave portion for positioning and housing the terminal-end 311 of the conductive wire 31 which forms the coil 30. More specifically, in the constitution of the magnetic element 10A shown in FIG. 5, the terminal unit 40A and the terminal-end 311 are in a state before being bent, but as shown in FIG. 4, for a finished product of the magnetic element 10A, the terminal unit 40 is bent so as to be directed toward the bottom surface of the core 20A. Then, the conductive-wire concave-portion 212A is formed as a concave portion for letting the bent terminal-end 311 enter thereinto.

It should be noted in the constitution shown in FIGS. 4 and 5 that the conductive-wire concave-portion 212A is provided such that the recess-depth thereof becomes deeper than that of the terminal concave-portion 211A. However, if it is possible to let the terminal-end 311 enter in, it is allowed for the conductive-wire concave-portion 212A to be designed to have a recess-depth in a similar range to that of the terminal concave-portion 211A, or the recess-depth may be shallower than that of the terminal concave-portion 211A.

It should be noted that the terminal concave-portion 211A and the conductive-wire concave-portion 212B correspond to the "core concave-portions" (this is true similarly for the terminal concave-portions 211B, 211C and the conductive-wire concave-portions 212B, 212C mentioned below).

In addition, for the terminal unit 40A, the positions that enter into the core 20A (not shown) and a pair of (bifurcated) root portions 41A protruding from the core 20A are provided in narrow widths. However, outwardly from the pair of root portions 41A, the terminal unit 40A has a configuration having wide-width portions 42A that are wider than the root portions 41A but still have a bifurcated shape. And there is formed a terminal cut-out portion 43A adjacent the center of the side surface 21A, between the bifurcated wide-width portions 42A of the terminal unit 40A. The terminal cut-out portion 43A is a portion at which the terminal-end 311 is positioned. And the terminal cut-out portion 43A has a predetermined length toward the downward direction.

Then, in the vicinity of the termination of this terminal cut-out portion 43A, there is formed a merging portion 44A by which the bifurcated wide-width portions 42A are merged. The merging portion 44A is provided to be sufficiently wider compared with the root portion 41A. Further, the outward side from the merging portion 44A forms a mount portion 45A which is bent so as to be directed toward the bottom surface of the core 20A. The mount portion 45A is a portion which is electrically connected to a mounting substrate, by a reflow or the like, when being mounted on the mounting substrate.

Here, as shown in FIG. 4, the terminal unit 40A does not enter into the terminal concave-portion 211A. It should be noted that the bending of this terminal unit 40A corresponds to the bending process which is carried out after the pressure-molding process. By the existence of this terminal concave-portion 211A, the terminal unit 40A is not broken in the pressure-molding process as mentioned above, and further, it is possible for the terminal unit 40A to be bent along the lower surface of the terminal concave-portion 211A and the side surface 21A to form a near right angle.

<3. With Regard to a Second Constitutional Example of Magnetic Element 10>

Figure 7:
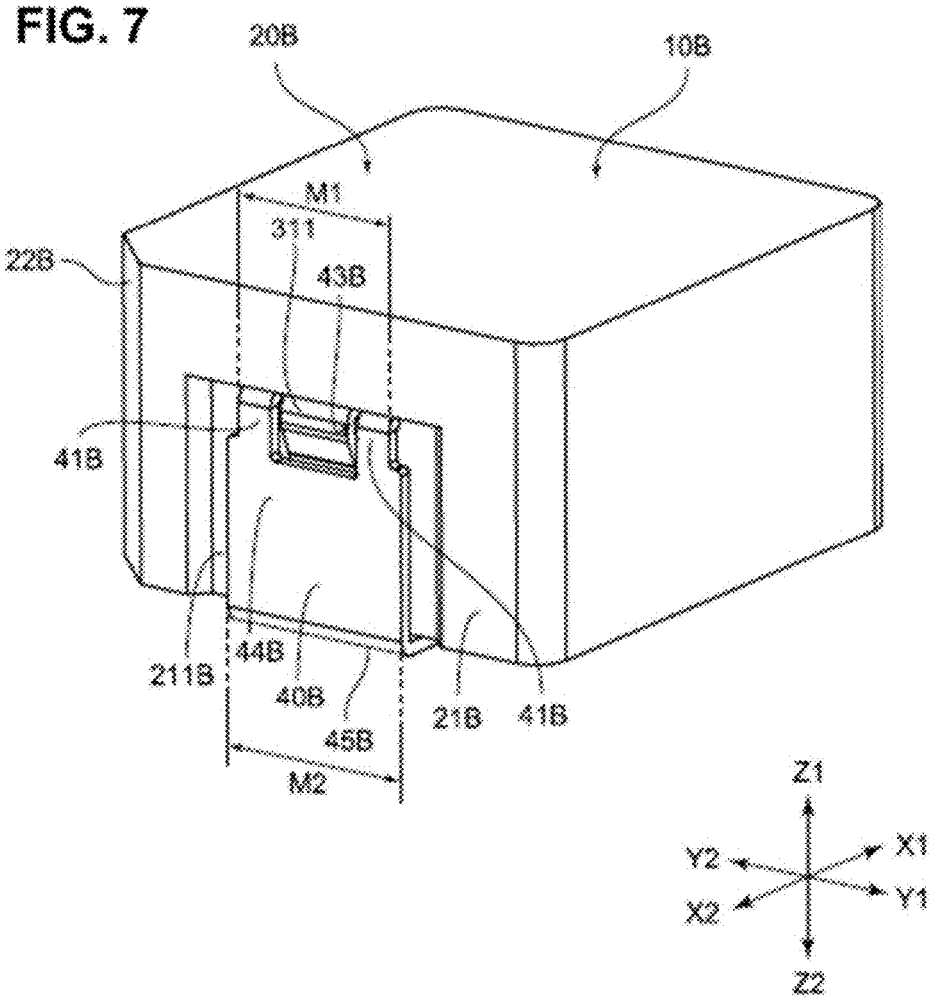
FIG. 7 is a perspective view showing a constitution of a magnetic element relating to a second constitutional example.
Figure 8:
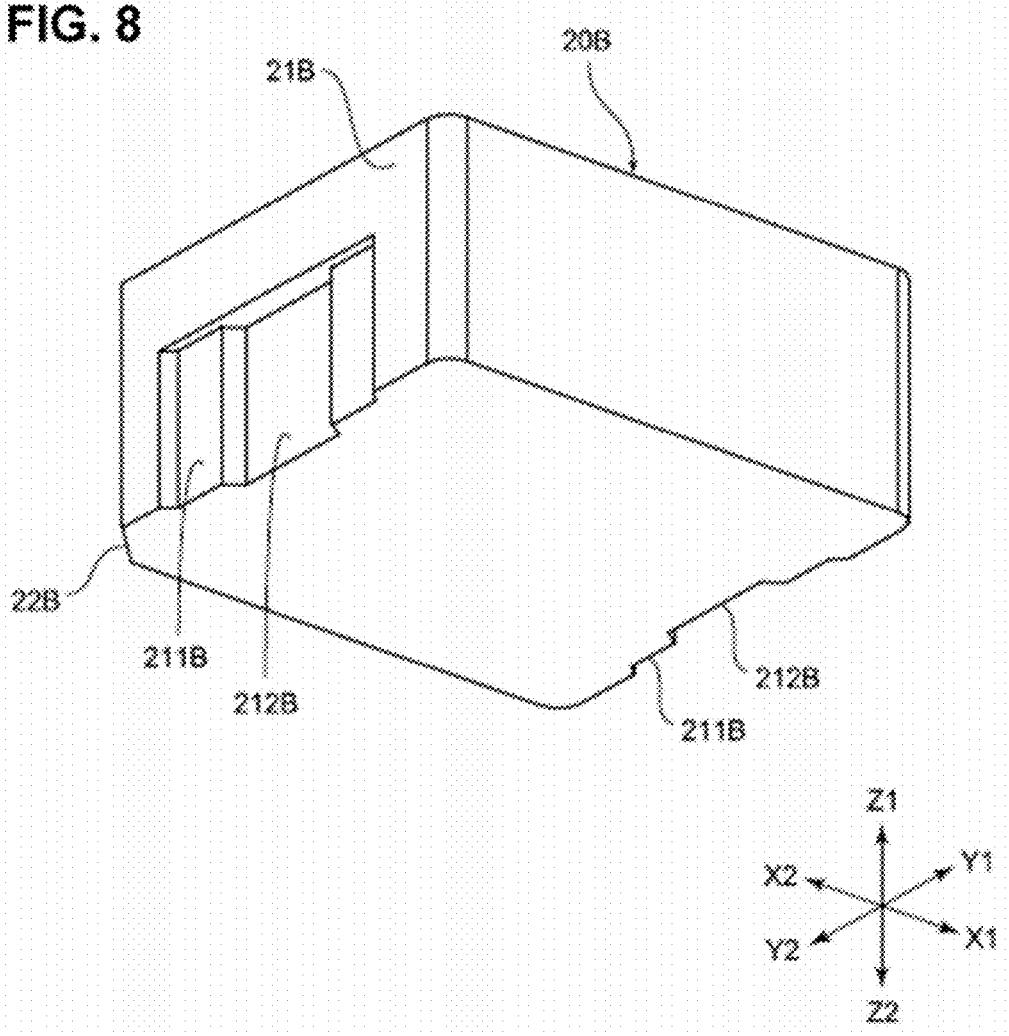
FIG. 8 is a perspective view showing a constitution of a core in the magnetic element relating to the second constitutional example and shows a state viewing the core from the lower side thereof.

Next, there will be explained a second constitutional example of the magnetic element 10 relating to this exemplified embodiment. It should be noted that, in the following explanation, the magnetic element 10 according to the second constitutional example is referred to as a magnetic element 10B and, in addition, it is assumed, also with regard to respective positions of the magnetic element 10B, that they will be referred to by putting the reference numeral "B" if needed. FIG. 7 is a perspective view showing a constitution of the magnetic element 10B according to the second constitutional example. FIG. 8 is a perspective view showing a constitution of a core 20B in the magnetic element 10B according to the second constitutional example and shows a state viewing the core 20B from the lower side thereof.

As shown in FIG. 7 and FIG. 8, for the core 20B relating to the second constitutional example, a terminal concave-portion 211B and a conductive-wire concave-portion 212B are provided integrally. More specifically, as shown in FIG. 8, the terminal concave-portion 211B is provided by using a large area and in the inside of the terminal concave-portion 211B there is provided a conductive-wire concave-portion 212B. Then, the conductive-wire concave-portion 212B is provided so as to be more recessed compared with the terminal concave-portion 211B.

Further, on the core 20B, there is also provided a cut-off portion 22B formed by cutting-off a portion of the corner portion for the positioning thereof.

Figure 9:
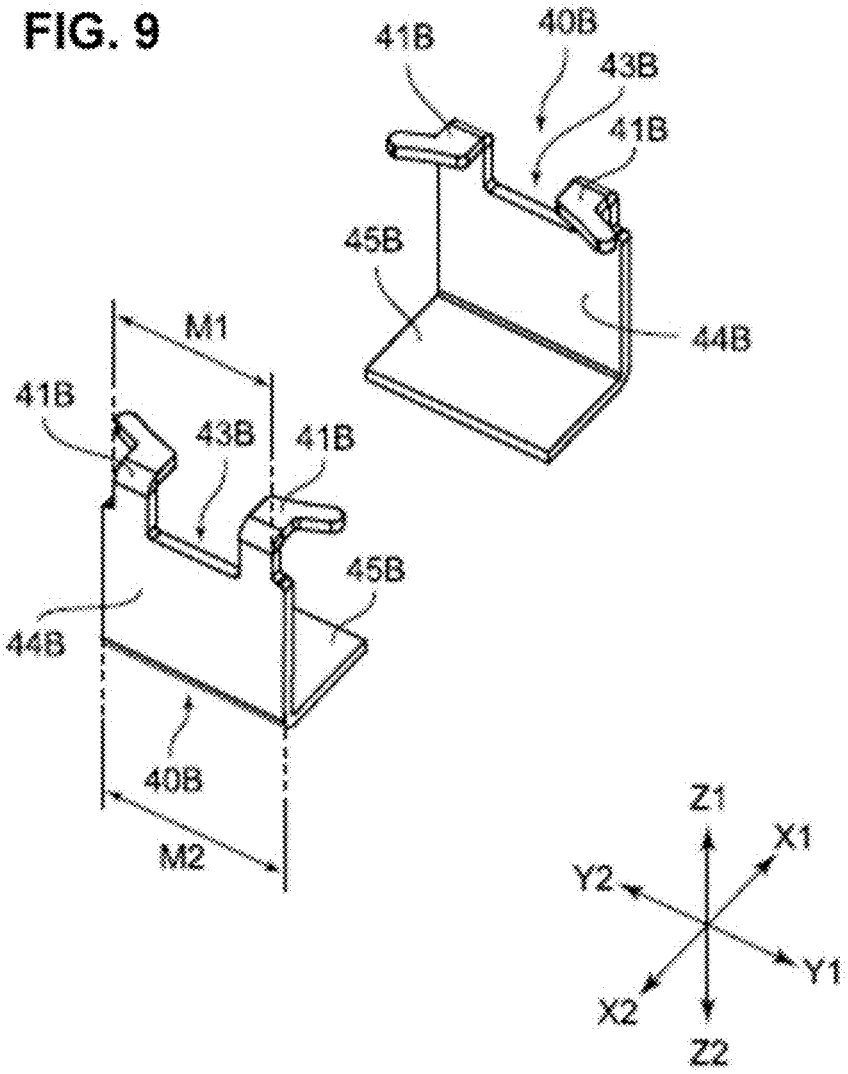
FIG. 9 is a perspective view showing a constitution of a terminal unit in the magnetic element relating to the second constitutional example.

FIG. 9 is a perspective view showing a constitution of a terminal unit 40B. As shown in FIG. 7 and FIG. 9, for the terminal unit 40B which represents a second constitutional example, there exists a pair of (bifurcated) root portions 41B corresponding to the root portions 41A mentioned above, and further, there is also provided a terminal cut-out portion 43B corresponding to the terminal cut-out portion 43A mentioned above. In addition, there is also provided a merging portion 44B which corresponds to the merging portion 44A and, further, there is also provided a mount portion 45B which corresponds to the mount portion 45A. However, as shown in FIG. 7, the terminal unit 40B is provided in a linear shape having a wide-width as a whole and the shape thereof is largely different from that of the terminal unit 40A of the magnetic element 10B.

Here, as shown in FIG. 7, for the pair of (bifurcated) root portions 41B, the size M1 from the outside of one of the root portions 41B to the outside of the other of the root portions 41B is provided to be smaller than the size M2 of the merging portion 44B in the width direction (Y-direction) thereof. More specifically, for the respective root portions 41B, the outsides thereof are recessed from the outsides of the merging portion 44B toward the center in the width direction. For this reason, it is possible to cause the following operational effect.

More specifically, when the magnetic material is pressure-molded, the magnetic material is positioned also between the terminal-end 311 and the root portion 41B. But there is a case caused by the pressure at the time of the pressure-molding in which the pair of root portions 41B are deformed so as to be enlarged toward the outsides in the width direction respectively. Then, in a case in which the size M1 mentioned above is supposed to be equal to the size M2, the root portions 41B are held by the mold 100. And it becomes difficult for the magnetic element 10B after the pressure-molding to be pulled out of the mold 100. In order to prevent difficulty in pulling-out from such a mold 100, the size M1 from the outside of one of the root portions 41B to the outside of the other of the root portions 41B is set to be smaller than the size M2 of the merging portion 44B in the width direction (Y-direction) and there is employed a configuration in which, at the time of the pressure-molding, it is allowed for the root portions 41B to be deformed so as to be spread.

For the magnetic element 10B of the second constitutional example, by employing such a constitution for the core 20B as mentioned above, it is possible to position and house the terminal unit 40B in the terminal concave-portion 211B. For this reason, it is possible to prevent the terminal unit 40B from protruding toward the outside from the side surface 21B and it is possible to reduce the size of the magnetic element 10B in the X-direction.

In addition, at the terminal concave-portion 211B, there is provided the conductive-wire concave-portion 212B so as to be more recessed compared with this terminal concave-portion 211B. For this reason, it becomes possible for the terminal-end 311 of the conductive wire 31 to escape into the conductive-wire concave-portion 212B.

In addition, by employing a shape in which there is formed a large-scaled terminal concave-portion 211B compared with the magnetic element 10A and the terminal concave-portion 211A mentioned above, also the length (size in the Y-direction) of the step 105 of the mold 100, which corresponds to this terminal concave-portion 211B, becomes longer. For this reason, it becomes possible for the step 105 of the mold 100 to receive the shear load by a relatively large area. Therefore, it becomes possible to reduce further the shear load which acts on the terminal unit 40B and, due to this fact, it becomes possible to prevent a phenomenon, in which the terminal unit 40 is to be broken, more effectively.

<4. With Regard to a Third Constitutional Example of Magnetic Element 10>

Figure 10:
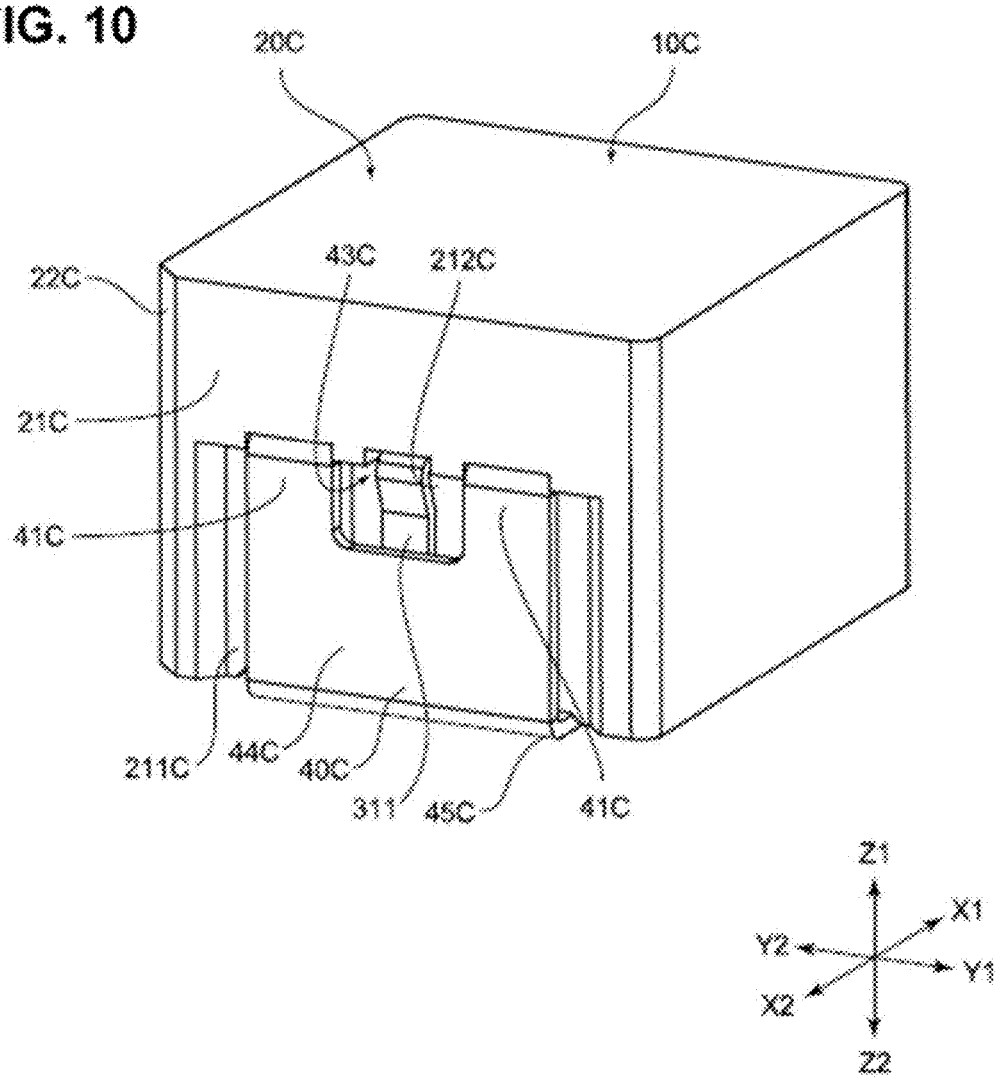
FIG. 10 is a perspective view showing a constitution of a magnetic element relating to a third constitutional example.

Next, there will be explained a third constitutional example of the magnetic element 10 relating to this exemplified embodiment. It should be noted in the following explanation that the magnetic element 10 according to the third constitutional example is referred to as a magnetic element 10C and, in addition, it is assumed, also with regard to respective positions of the magnetic element 10C, that they will be referred to by putting the reference numeral "C" if needed. FIG. 10 is a perspective view showing a constitution of the magnetic element 10C according to the third constitutional example.

Figure 11:
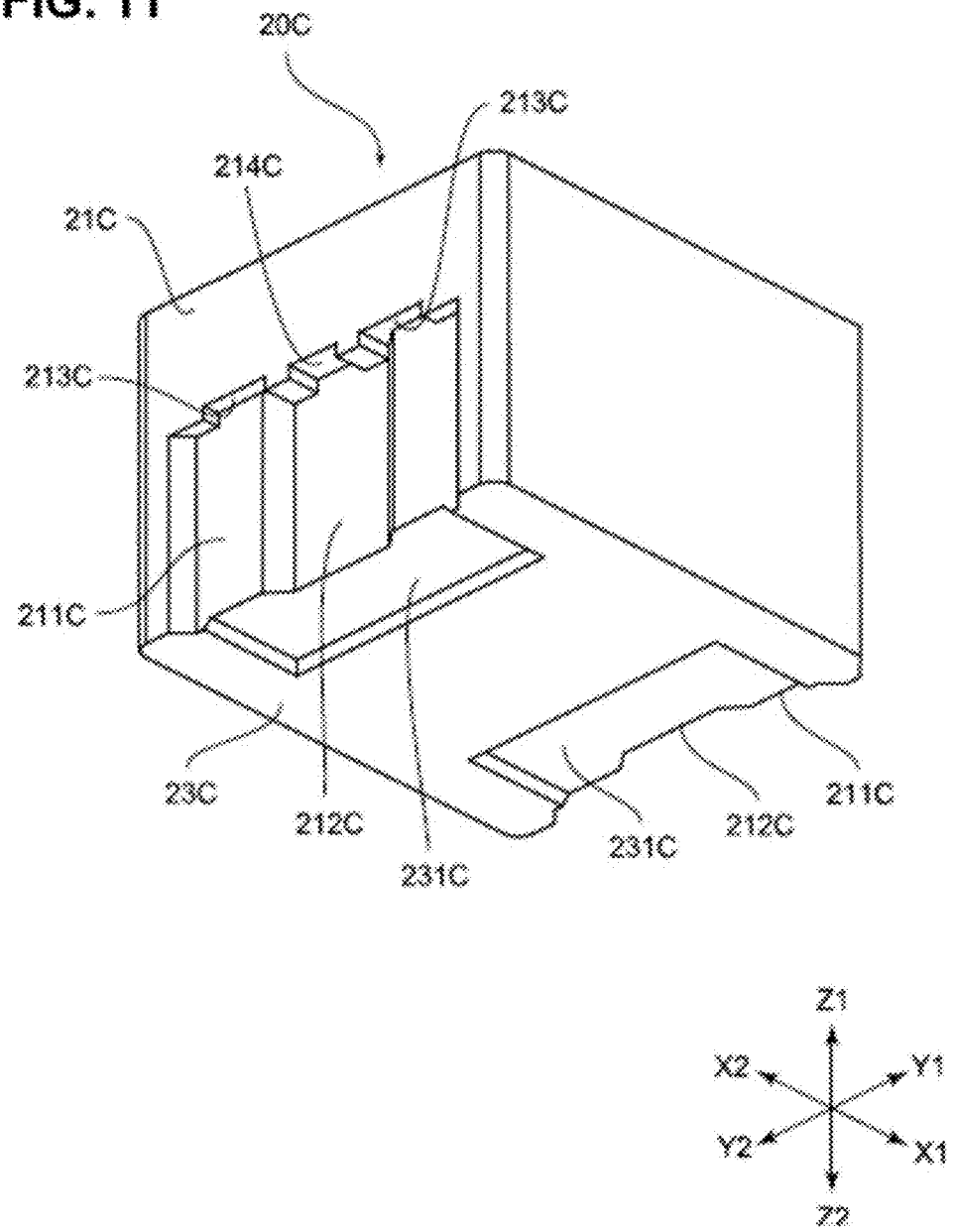
FIG. 11 is a perspective view showing a constitution of a core in the magnetic element relating to the third constitutional example and shows a state viewing the core from the lower side thereof.

FIG. 11 is a perspective view showing a constitution of a core 20C in the magnetic element 10C according to the third constitutional example and shows a state viewing the core 20C from the lower side thereof.

Similarly to the terminal concave-portion 211B and the conductive-wire concave-portion 212B which relate to the second constitutional example mentioned above, also for the core 20C relating to the third constitutional example, as shown in FIG. 10 and FIG. 11, there are provided a terminal concave-portion 211C and a conductive-wire concave-portion 212C integrally. Further, on the side surface 21C of the core 20C, there are also provided an upward terminal concave-portion 213C and an upward conductive-wire concave-portion 214C other than the terminal concave-portion 211B and the conductive-wire concave-portion 212B which are mentioned above. The upward terminal concave-portion 213C is a concave portion which is recessed toward the upward direction from the terminal concave-portion 211C and, at this upward terminal concave-portion 213C, a root portion 41C of a terminal unit 40C is positioned. In addition, the upward conductive-wire concave-portion 214C is a concave portion which is recessed toward the upward direction from the conductive-wire concave-portion 212C and, at this upward conductive-wire concave-portion 214C, a terminal-end 311 is positioned.

It should be noted that the upward terminal concave-portion 213C and the upward conductive-wire concave-portion 214C are also provided integrally with the terminal concave-portion 211C and the conductive-wire concave-portion 212C which are mentioned above. In addition, also the upward terminal concave-portion 213C and the upward conductive-wire concave-portion 214C correspond to the "core concave-portions".

Further, on the bottom surface 23C of the core 20C, there is provided a mounting concave-portion 231C into which the mount portion 45C enters. The mounting concave-portion 231C is a portion which is recessed so as to be directed upward from the bottom surface 23C and is provided so as to be continuous with the terminal concave-portion 211C.

In addition, the terminal unit 40C is formed in a similar shape to that of the terminal unit 40B in the second constitutional example mentioned above. On the other hand, for the terminal unit 40C, the size M1 from the outside of one root portion 41C to the outside of the other root portion 41C is set to be equal to the size M2 of the merging portion 44C in the width direction (Y-direction). However, it is allowed also for the terminal unit 40C to be formed such that the size M1 and the size M2 mentioned above do not become equal.

For the magnetic element 10C having such a constitution, the root portion 41C of the terminal unit 40C enters into the upward terminal concave portion 213C and, further, the terminal-end 311 enters into the upward conductive wire concave portion 214C. Therefore, when pressure-molding the magnetic material by the mold 100, it is allowed for the magnetic material to enter-into the space between the terminal-end 311 and the root portion 41C and it becomes possible to simplify the shape of the mold 100.

The lower surface of the root portion 41C of the terminal unit 40C and that of the terminal-end 311 may be made coplanar if, during formation of the core 20C one of the lower-side die or the upper-side die has a flat shape at the location where the root portion 41C of the terminal unit 40C and the terminal-end 311 are positioned. Preferably this flat shape is provided on the lower die. Having described preferred embodiments of the invention with reference to the accompanying drawings, it is to be understood that the invention is not limited to those precise embodiments and that various changes and modifications could be effected therein by one skilled in the art without departing from the scope of the invention as defined in the appended claims.

What is claimed is:

1. A magnetic element, comprising:

a coil having two terminal-ends, a core pressed and molded around the coil, and two terminals connecting to the two terminal-ends of the coil, wherein a first concave is formed on a side surface of the core, a second concave for accommodating one of the two terminal-ends of the coil, is formed as a recess toward to a upward direction from the first concave at a upper boundary of the first concave and from where the terminal-ends of the coil are extended from the core to outside, and a third concave for accommodating one of roots the two terminals, is formed as a recess toward to a upward direction from the first concave at a upper boundary of the first concave and near the second concave, and from where the root of one of the two terminals is extended from the core to outside, wherein lower surfaces of the roots of the two terminals positioned in the third concaves, and a lower surface of one of the terminal-end of the coil positioned in the second concave are formed coplanar.

2. The magnetic element according to claim 1, wherein a fourth concave is formed integrally in the first concave, and is wider than the first concave.

* * * * *